United States Patent [19]

Freeman

[11] 4,304,080

[45] Dec. 8, 1981

[54] CONSTRUCTION BEAM

[75] Inventor: Richard B. Freeman, Wilmington, Del.

[73] Assignee: The Budd Company, Troy, Mich.

[21] Appl. No.: 116,036

[22] Filed: Jan. 28, 1980

[51] Int. Cl.[3] ..... E04C 2/34; E04B 2/32

[52] U.S. Cl. ..... 52/309.9; 52/595; 52/309.11

[58] Field of Search ..... 52/309.9, 309.11, 309.4, 52/233, 404, 406, 595, 593, 594, 588, 589, 309.8

[56] References Cited

U.S. PATENT DOCUMENTS

| | | | |
|---|---|---|---|
| 2,021,341 | 11/1935 | Ward | 52/233 |
| 3,643,394 | 2/1972 | Johnson | 52/309.11 |
| 3,760,548 | 9/1973 | Sauer et al. | 52/309.11 X |
| 3,834,101 | 9/1974 | Wilder et al. | 52/309.11 |
| 4,034,528 | 7/1977 | Sanders et al. | 52/309.4 |
| 4,126,977 | 11/1978 | Chisum | 52/233 |
| 4,183,393 | 1/1980 | Bailey | 52/309.9 |

FOREIGN PATENT DOCUMENTS

| | | | |
|---|---|---|---|
| 2445180 | 4/1976 | Fed. Rep. of Germany | 52/309.9 |
| 6805282 | 10/1968 | Netherlands | 52/309.8 |
| 1567161 | 5/1980 | United Kingdom | 52/309.9 |

*Primary Examiner*—J. Karl Bell
*Attorney, Agent, or Firm*—A. L. Trueax, Jr.

[57] ABSTRACT

A construction beam includes solid strips of material forming inner and outer skins. Foam plastic material is disposed between the solid strips. Means are provided along the top and bottom of the strips to interlock one beam with a next adjacent beam to form a structure. Means for locking the strips to the foam plastic material may be provided.

7 Claims, 8 Drawing Figures

FIG. 1
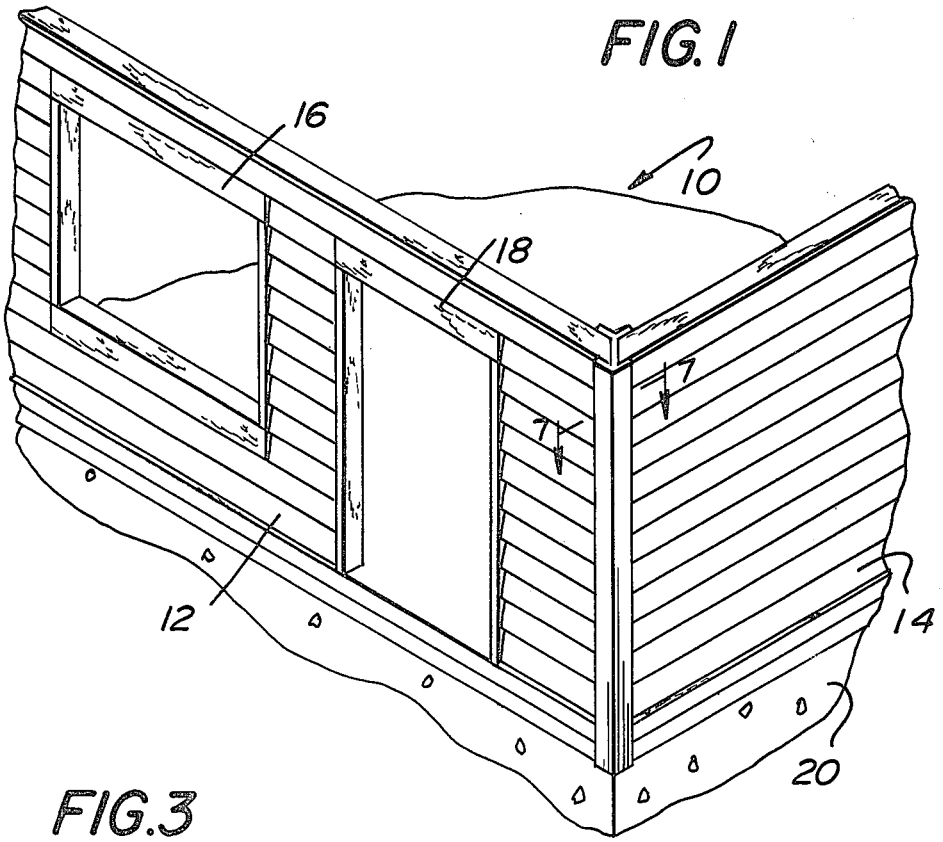
FIG. 3
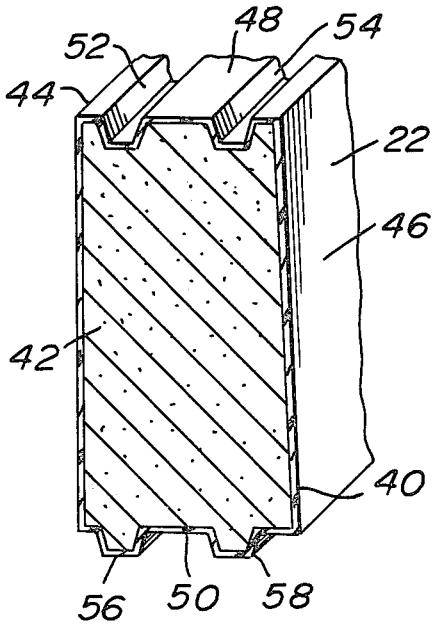
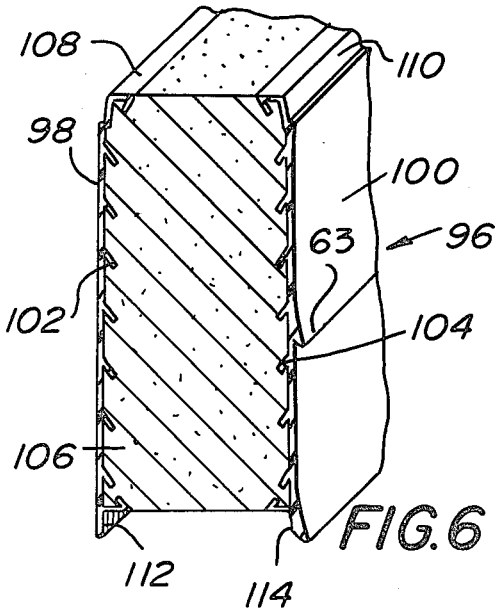
FIG. 6

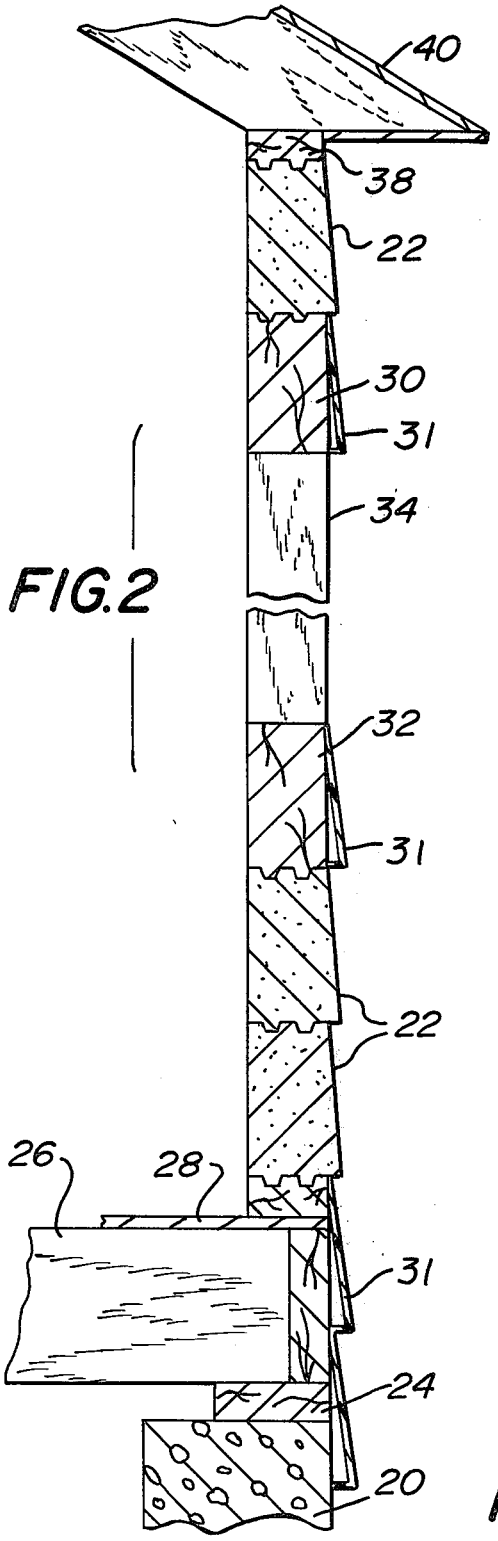
FIG.2
FIG.5
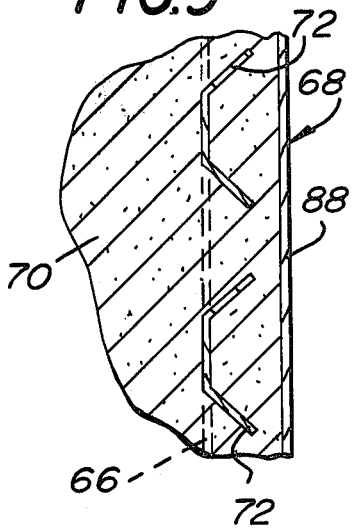
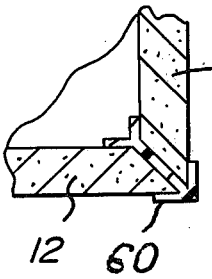
FIG.7
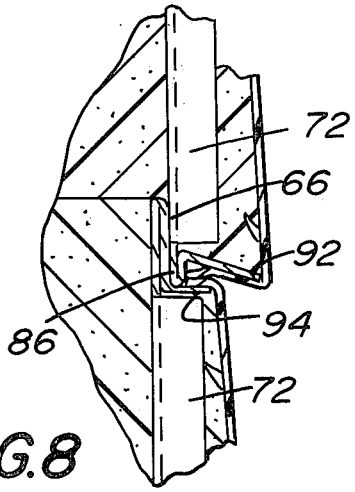
FIG.8

CONSTRUCTION BEAM

BACKGROUND OF THE INVENTION

1. Field of the Invention

Solid beams have been used in the construction of walls in building. A notable use of such beam is the log cabin where individual logs are stacked one upon another to form a wall. In some cases, the logs include cut-away portions to provide interlocking means between the logs as exemplified in U.S. Pat. No. 2,021,341.

2. Prior Art

Various building blocks including insulating material have been considered in the past. Also precast structural parts made from plastic material have been considered, as disclosed in U.S. Pat. No. 1,619,737.

One of the reasons why the use of factory built components for structural applications in the construction industry has failed to make significant inroads has been partly because of the versatility of stud frame construction using wood members. In many cases, if the factory built components could be conveniently substituted and made as versatile as the ordinary 2×4 inch stud and 4×8 foot sheet construction, it would gain high acceptability.

OBJECTS OF THE INVENTION

It is an object of this invention to provide an improved beam for a building having high insulation properties.

It is a further object of this invention to provide an improved beam for a building which includes high insulation properties and includes interior and exterior finishings.

It is still a further object of this invention to provide an improved building beam which minimizes the amount of labor required in the construction of a building.

It is still a further object of this invention to provide construction beams which do not require any additional support structures and which make it possible to construct substantially the entire walls of a building on a site in a minimum of time.

It is still a further object of this invention to provide improved construction beams which requires relatively low labor skills to assemble into a building.

BRIEF SUMMARY OF THE INVENTION

In accordance with the present invention, a beam for use in a wall or other structure in a building includes an outer skin which may be made of metal or vinyl resembling an exterior siding and an inner skin which may provide the interior surface for the building. Plastic foam is disposed between the inner and outer skins to provide insulation. Interlocking means are provided at the top and bottom edges of the beam to permit a plurality of beams to be interlocked to provide a wall structure. Locking projections may extend from one or both of the skins to lock them to the plastic material.

Other objects and advantages of the present invention will be apparent and suggest themselves to those skilled in the art, from a reading of the following specification and claims, taken in conjunction with the accompany drawings.

BRIEF DESCRIPTION OF THE DRAWINGS

FIG. 1 is a perspective view of a portion of a building of a type which may utilize a beam made in accordance with the present invention;

FIG. 2 is a cross-section view taken through the window area of FIG. 1;

FIG. 3 is an isometric cross-sectional view of one of the beams illustrated in FIGS. 1 and 2;

FIG. 5 is a cross-sectional view taken along lines 5—5 of FIG. 4;

FIG. 6 is a cross-sectional view of another embodiment of a beam, in accordance with the present invention;

FIG. 7 is a detailed view illustrating one type of corner connection which may be used with the present invention; and FIG. 8 is an enlarged detail view illustrating a sealing effect between two stacked beams, in accordance with the present invention.

DETAILED DESCRIPTION OF THE EMBODIMENTS

Figure 4:
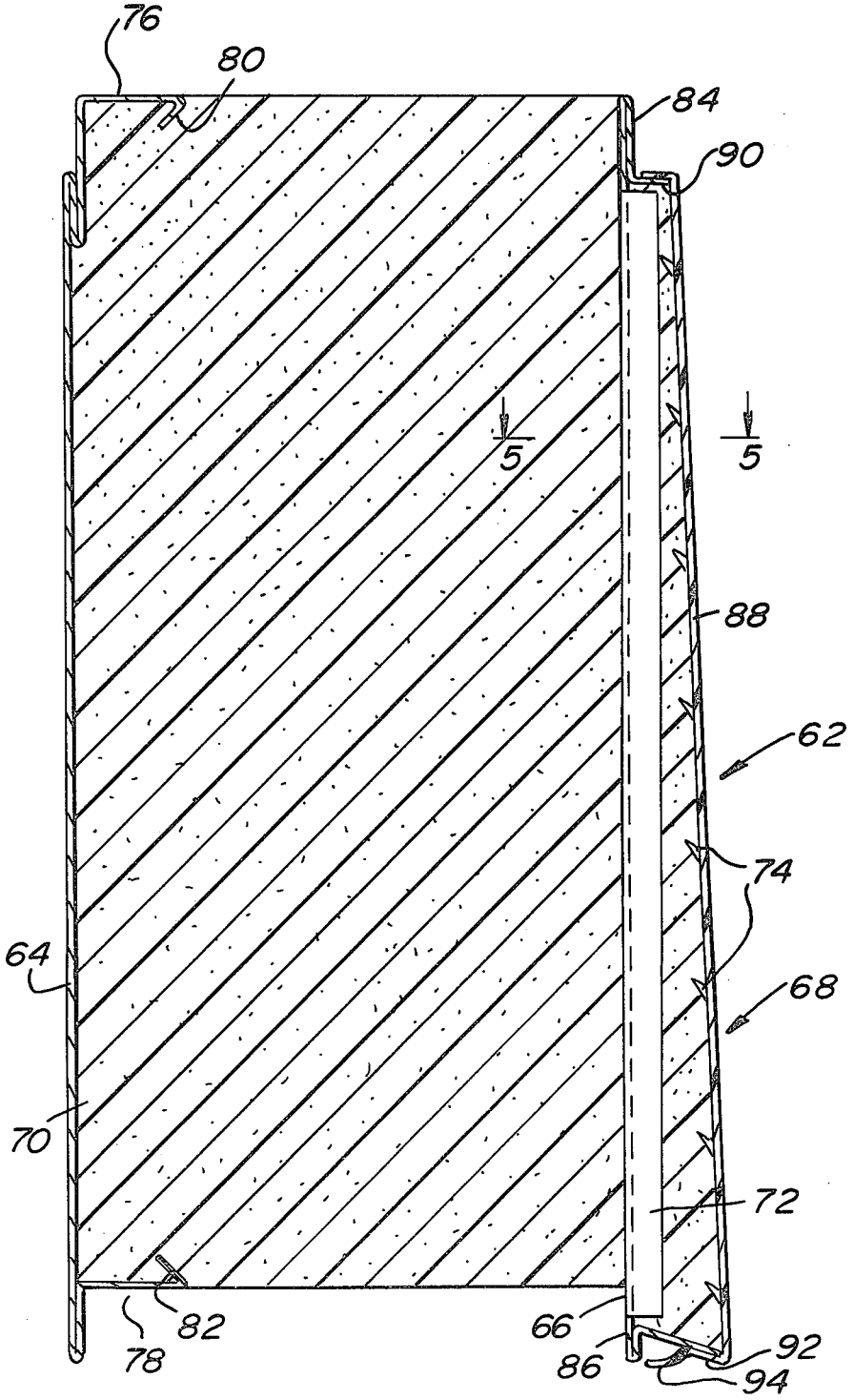
FIG. 4 is a cross-sectional view of another embodiment of a beam, in accordance with the present invention.

Referring particularly to FIG. 1, a building 10 includes a front wall 12 and a side wall 14. The front wall 12 includes a window 16 and a door 18. The building 10 is built on a foundation 20 which may be concrete or other conventional material. The building 10 is conventional as far as the external appearance is concerned. However, the beams used in constructing the walls are of the type involved in the present invention.

Referring to FIG. 1, a plurality of beams 22, built in accordance with the present invention, are stacked one upon another to form the walls 14 and 12 of the building. While in some cases, the present invention may be involved in the construction of the ceiling and roof of the building, it will be assumed that only the walls utilize the beam of the present invention and that the rest of the building 10 is conventional or utilizes conventional parts. The beam 22 includes inner locking portions, as will be described, so that the edge of the bottom beam will fit into the edge of the next adjacent top of the beam. A sill 24 of the conventional type may be disposed upon the foundation 20. Suitable floor joists 26 are disposed on top of the sill 24. The floor joists 26 may be conventional wood and include a subflooring 28 which may also be conventional. The construction is not limited to the support members described but could also include slab type construction. The areas around the door and the window of the building 10 may be made of wood, as illustrated by the area around the window which includes a top wooden beam 30, a bottom wooden beam 32 and an interconnecting side beam 34. The beams 30 and 32 may or may not include interlocking positions. The beams may include dummy siding 31 attached thereto. The beams 22 rest on a wood sole plate 36 which may or may not include top interlocking portions to lock with the bottom of a beam 22. Dummy siding 31 may also be connected towards the bottom of the main beams 22. The top of the wall formed by the beams 22 include a wood header member 38 to support the roof 40 of the building 10. All the parts described except the beams 22 may be of conventional construction and therefore are not described in any further detail.

Referring particularly to FIG. 3, one type of construction beam as illustrated in FIGS. 1 and 2 is shown. The beam 22 which may be an elongated member extending horizontally between the ends of two connecting posts includes a shell 40. The shell 40 may comprise plastic and may be in the order of 0.060 inches in thickness. A plastic material 42 is disposed to fill all the open areas within the shell 40. One type of plastic material which may be used is a rigid polyurethane foam compressed at about 3.0 pounds/cubic foot.

The beams 22 may be considered as having an inner skin 44 and an outer skin 46. In the embodiment of FIG. 3, the inner and outer skins 44 and 46 are joined by top portion 48 and bottom portion 50. The outer skin 46 extends downwardly at an angle so that the overall appearance of the exterior of the beam is that of siding. This siding effect is pronounced when the building block 22 is connected to top and bottom adjacent blocks.

In other words, the top portion 48 is slightly narrower than the bottom portion 50.

The top portion 48 includes elongated recesses 52 and 54 which extend along the entire top of the beam 22. The bottom portion 50 includes a pair of parallel extensions 56 and 58 which also extend along the entire length of the bottom of the beam 22. The extensions 56 and 58 are dimensioned to fit into the recesses 52 and 54 of the next adjacent top portion of a beam. In like manner, the recesses 52 and 54 are adapted to receive the extensions 56 and 58 from an adjacent top beam. An adhesive may be provided between each beam. This may be provided for additional strength or to prevent air or moisture from leaking through the wall structure.

The plastic foam material 42 may be sized to equal the compressive load carrying capabilities of a construction grade spruce 2×4 foot studs which is placed 16 inches on center. When a single story house is being considered, the plastic foam thickness could be reduced.

It is noted that the exterior of the wall formed by the beams 22 create a siding like effect. The inside of the wall formed by the beams, however, is substantially straight. The interior wall would include a series of horizontal joints. Dependent upon the severity, the interior surface may be painted with a highly textured paint to take care of the horizontal joints. Of course, conventional paneling could be installed by conventional adhesive to the interior surface. If wall paper or thin paint is used, then it is likely that additional finishing would be required on the inside. However, for many types of construction, the interior surface of the wall formed by the beams 22 would be acceptable and no further finishing would be required. It is also noted that the plastic shell 40 could be pigmented to any desired color so that the exterior siding would not have to be finished in any way and would be relatively maintenance free.

An important feature of the plastic material 42 is the insulating properties provided. The insulating properties provided should be better than conventional wood stud frame construction using fiberglass insulation.

The electrical wiring for the construction illustrated could be run in commercially available hollow base board moldings. This is not illustrated because it is not directly related to the present invention.

In the case of a single level building, any type of heating system may be used and all the necessary parts to provide the heat, electrical, hot water or hot air could be accomplished by means disposed through the floor of the building. However, if additional levels are considered, then it may be necessary to run the hot air or hot water heat up through an interior stud wall.

As illustrated in FIG. 7, the corners of the plastic beams 22 may be cut at an angle at their ends and joined together in the manner illustrated. A plastic extruded piece 60 may include end portions to receive the ends of the beams 22 therebetween. The extrusion 60 may be suitably secured to the ends of the beam 22 by adhesive. It is apparent that various conventional means for joining the plastic beams 22 at the corners, tops and bottoms, of other elements in the building may use conventional means. Because of their wide varity of such methods and means which may be used, and because such means are only incidentally related to the present invention, additional details relating thereto are not illustrated or described.

Referring to FIGS. 4 and 5, a different and preferred embodiment of the present invention is illustrated. It is understood that the beams illustrated in cross-section may be utilized in the manner illustrated in the previous figures described. In the embodiment of FIG. 4, a shell enclosing plastic foam is not utilized. In place of the shell, thin roll formed steel vertical members with foam therebetween are utilized. No covering of the foam at the top or bottom is provided. In addition to a pair of thin roll formed steel vertical members, an extruded rigid vinyl covering is utilized to form the siding effect for the exterior surface. A beam 62 includes an inner steel skin 64 and an outer steel skin 66. A vinyl covering 68, extending at a downward angle with respect to the main surfaces of the steel skins 64 and 66, provide an overall siding effect, such as described in connection with previous FIG. 3. In the manufacture of the beam 62, the pieces 64, 66 and 68 are placed in position in a suitable mold. Plastic material 70, which comprises a foam material is inserted between the steel skins 64 and 66. As the plastic material 70 foams in the mold in a conventional manner, it passes from the area between the steel skins 64 and 66 through perforations in the steel skin 66 into the area between the skin 66 and the vinyl covering 68. The perforations are provided by metal flanges 72 which are punched in the skin 66 and extend into the area toward the vinyl cover 68. The perforations in the skin 66 allow the foam plastic material to pass through the skin 66 to contact the vinyl covering 68 thus forcing it to take the desired shape of the mold. Such methods for molding pieces are well known and therefore not shown or described in further detail. It is sufficient to say that the plastic material 70 becomes hard and forms an insulating material for the beam 62. Rigid foam cores are discussed in an article entitled "Urethane Fills Inside Role in New Profile Compositions" in the October, 1979 issue of "Modern Plastics" on pages 58 and 59.

Because the foam plastic 70 will normally not bond to materials such as vinyl, locking tabs 74 are provided to lock the vinyl cover 68 to the plastic material 70. These locking tabs 74 may be extruded with the main body of the vinyl covering and provide a mechanical lock with the plastic foam 70. The locking tabs 74 extend angularly upwardly into the plastic material 70 in the manner illustrated but could extend downwardly.

The steel skin 64 may include overlapping portions toward the top so as to provide a top extension 76 along with the top portion of the skin 66. The bottom of the skin 64 includes an overlapping section to provide a recess or interlocking area 78 along with the bottom portion of the skin 66. The beam 62 may be stacked on other similar beams in the same manner as illustrated in FIG. 2.

The ends 80 and 72 are bent inwardly into the plastic 70 to maintain the skin 64 in place along with the certain amount of adhesion that takes place between the plastic material and the steel skin. The top of the skin 66 includes an L-shaped bent portion having an area 84. The bottom of the skins 66 include a perpendicular inwardly extending portion 86 the end of which makes contact with the vinyl covering 68.

The vinyl covering 68 includes a main front surface 88 having a top surface 90 extending over the bottom of the "L" section of the area 84 and a bottom surface 92 extending inwardly from the front surface.

The flanges 72 in addition to providing means to permit the plastic foam to pass therethrough also provides resistance to deformation of the skin as the plastic passes therethrough during the manufacture of the beam. Normally, when the plastic foam passes through it will exert a certain pressure which could conceivably distort the skin 66. In addition, the flanges 72 provide additional stability with the foam during a vertical compressive load.

The bottom portion 92 includes a downwardly projecting lip portion 94. This lip portion provides a moisture seal when one of the beams is stacked with a next adjacent beam. This sealing feature is illustrated in FIG. 8.

Generally steel strips or skins are employed to meet certain flammability requirements. Also, the use of metal provides additional structural strength for the beam. In some cases, however, the flammability requirements and structural requirements may be somewhat relaxed especially in some cases involving single story construction.

Referring particularly to FIG. 6, another embodiment of the present invention is illustrated. The plastic beam 96 includes an inner extruded plastic strip 98 and an outer extruded plastic strip 100. The strips 98 and 100 include integral locking tabs 102 and 104, respectively. The strips or skins 98 and 100 are substantially parallel with respect to each other and may or may not include tapered surfaces 63 to provide a siding appearance on the outside.

A low density plastic foam material 106 is disposed between the strips 98 and 100 during the molding process. During the molding process, the pieces 98 and 100 are held in the mold and the plastic foam is inserted to force the pieces against the mold to form the beam 96. Again, the plastic material 106 is allowed to foam and harden and provide a suitable insulating material for the beam 96.

The strips 99 and 100 could be substantially the same thereby considerably cutting the cost of manufacturing. The strips 98 and 100 include top portions 108 and 110 which are recessed slightly with respect to the main surface thereof. The bottom extensions 112 and 114 extend from the pieces 98 and 100 beyond the plastic material 106. The extensions 108 and 110 of the beam 96 fit between the extensions 112 and 114 of the next top adjacent beam. Likewise, the bottom extensions 112 and 114 are adapted to receive the extensions from the next bottom adjacent beam.

The pieces 98 and 100 could include finishes suitable for acceptance in some cases. As in the previous applications or embodiments, adhesive may be used to join the adjacent beams together.

It is seen that the present invention has provided a beam making it capable of being used in the construction of an external wall structure of a building. Because of the stacking involved, the labor requirement is greatly minimized. In addition, the use of the plastic foam material provides high insulation for the building. Thus additional operations requiring the installation of insulating material is eliminated, again reducing the cost of labor involved. Also, the siding effect developed from stacking the beams eliminates the need to subsequently install an exterior siding, again reducing the cost.

While the present invention has been described in connection with wall structures, in some cases the beams may be used to form parts of the roof structure or other parts of a structure in the building. The use of such beams in other locations in the building would depend upon the particular loading conditions encountered.

What is claimed is:

1. A beam for use in a structure of a building comprising:

a. a first elongated strip forming an outer skin for said beam;

b. a second elongated strip spaced from said first elongated strip forming an inner skin for said beam;

c. plastic foam material disposed in substantially the entire space between said first and second elongated strips to form top and bottom edges for said beam;

d. interlocking means forming part of said top and bottom edges to permit interlocking of the top edge of one beam to the bottom edge of an adjacent beam to form said structure; and e. said first and second elongated strips each include a plurality of angular projecting portions extending inwardly from the inner surfaces of said elongated strips into said plastic material along the entire length of said strips to mechanically lock said first and second strip to said plastic material.

2. A beam as set forth in claim 1 wherein said first and second elongated strips comprise metal.

3. A beam as set forth in claim 1 wherein said first and second strips comprise plastic extrusions, and said plastic material comprises a relatively low density plastic foam.

4. A beam for use in a structure of a building comprising:

a. a first elongated metal strip forming an outer skin for said beam;

b. a second elongated metal strip spaced from said first elongated strip forming an inner skin for said beam;

c. plastic foam material disposed in substantially the entire space between said first and second elongated strips to form top and bottom edges for said beam;

d. interlocking means forming part of said top and bottom edges to permit interlocking of the top edge of one beam to the bottom edge of an adjacent beam to form said structure; and e. a vinyl cover secured to said first elongated strip, said cover extending angularly away from said first strip to provide a space therebetween filled with said plastic material.

5. A beam as set forth in claim 4 wherein said first strip includes perforations therein to receive said plastic material therethrough.

6. A beam as set forth in claim 5 wherein said vinyl cover includes projections extending inwardly in the area between said first strip and said vinyl cover to lock said vinyl cover to said plastic material.

7. A beam as set forth in claim 6 wherein said plastic material comprises rigid polyurethane foam providing insulation in said beam.

* * * * *